United States Patent [19]

Gaspar

[11] Patent Number: 4,907,641

[45] Date of Patent: Mar. 13, 1990

[54] ROTATABLE CRUCIBLE FOR RAPID SOLIDIFICATION PROCESS

[75] Inventor: Thomas Gaspar, Bexley, Ohio

[73] Assignee: Ribbon Technology Corporation, Gahanna, Ohio

[21] Appl. No.: 290,274

[22] Filed: Dec. 27, 1988

[51] Int. Cl.[4] ..... B22D 11/06

[52] U.S. Cl. ..... 164/423; 164/429

[58] Field of Search ..... 164/423, 427, 429, 463, 164/479

[56] References Cited

FOREIGN PATENT DOCUMENTS 2070479 9/1981 United Kingdom ..... 164/429

*Primary Examiner*—Kuang Y. Lin

*Attorney, Agent, or Firm*—Frank H. Foster

[57] ABSTRACT

This invention relates to an apparatus for producing filament, fiber, ribbon or film from a molten material, comprising a preferably heat extracting crucible which contains a pool of molten material at a selected horizontal level in the pool. The crucible has an opening extending from above the free surface level to a bottom edge of the opening, the bottom edge being sufficiently below the free surface level so that the molten material cannot form and hold a meniscus by surface tension between the edge and the level of the free surface and further comprises a heat extracting substrate laterally disposed with respect to the crucible and which rotates about an axis of rotation. The substrate is positioned adjacent the edge of the opening which confines the molten material and prevents it from overflowing downwardly out of the crucible. The invention features rotating means which includes a first drive means for tiltably rotating the crucible about an axis of rotation which is coaxial with the axis of rotation of the substrate, so the crucible edge can be maintained a predetermined constant distance from the substrate. The distance chosen is suitable for depositing molten material on the substrate and the apparatus also has a second drive means which is drivingly connected to the substrate for continuously moving the surface of the substrate upwardly past the edge and a melt front formed at the interface of the molten material and the substrate surface.

12 Claims, 4 Drawing Sheets

ROTATABLE CRUCIBLE FOR RAPID SOLIDIFICATION PROCESS

This invention was made with Government support under contract NAS1- 18288 awarded by NASA. The Government has certain rights in this invention.

TECHNICAL FIELD

This invention relates to an apparatus for producing filament, fiber, ribbon or film from a molten material and, more particularly, relates to an apparatus system for producing such products from reactive materials such as metals, polymers and ceramics.

BACKGROUND ART

The prior art discloses a variety of methods and apparatus which produce solid material directly from a source of molten material. Most prior art systems are for the fabrication of metal products and use some type of fixed, rigid, noncontrollable forming orifice to stabilize the dimensions of the product.

A typical system of this type is illustrated in U.S. Pat. No 2,825,108, which discloses molten metal being made into filamentary form by forcing it through an orifice so as to generate a free standing stream of molten material which is subsequently solidified into filamentary form on a rotating, heat-extracting member. The rate of production is determined by the rate at which the molten material is expelled from the orifice and for continuous filament this rate must be approximately synchronous with the rate of movement of the heat extracting member at its point of contact with the filament.

U.S. Pat. No. 3,838,185 to Maringer et al. discloses a disc-like heat extracting substrate which is rotated and lowered into the upper surface of a molten material. The peripheral edge of the disc-like substrate is generally parallel to the surface of the molten material. More specifically, the edge moves slightly downwardly through the surface of the melt into a region of contact and then moves upwardly and out of the melt carrying a layer of molten material which is then chilled as the wheel rotates and carries it away from the surface of the molten material. After the layer is solidified, it is removed from the substrate in the form of a filamentary product without the use of forming orifices.

One difficulty with this system however, is that, because the heat extracting substrate is inserted downwardly into the surface of the melt, the melt surface must be open and exposed to the atmosphere. This exposure to the atmosphere is a major source of heat loss and therefore increases the energy required to maintain the molten material surface at a suitably high temperature for proper operation of the system. Secondly, the position of the heat extracting substrate over the melt does not allow line of sight access to the melt, which is necessary for efficient melting with a directed energy source like a plasma, an electron beam or a laser. The heat extracting substrate casts a shadow over the melt that may result in either a semi-solid or frozen melt pool and thus inhibits casting of filament. Further, this system permits limited control because the region of contact of the melt with the substrate must always be at the lower-most segment of the substrate. Thus, control of the process is limited to control of the substrate speed, depth of penetration of a substrate into the surface of the molten material and the temperature.

The second system for overcoming some of these objectional characteristics is disclosed in U.S. Pat. No. 3,896,203 to Maringer et al. In this patent, a melted drop of material is adhered to a solid member by means of the molecular attraction of the molten material of the solid member to form an adherent pendant drop. The drop is suspended from the solid member. The drop remains adherent because the net molecular attraction force is greater than the net gravitational force on the drop. The adherent pendant drop is then contacted by a rotating, heat-extracting member. The pendant drop may be formed by locally heating the end of the solid member of the material to melt the end. Alternatively, the pendant may be formed, adhered to and suspended from a orifice through which melt is forced, for example, by the pressure head exerted by the height of molten material above the orifice. However, this system has also been hampered by a variety of difficulties, particularly in connection with the instability of the pendant drop mechanism.

U.S. Pat. No. 993,904 to Strange discloses a primitive version of which is the preferred process in which to utilize the apparatus of the present invention.

The art of molten metal casting onto substrates has extremely limited experience in developing a tiltable crucible in connection with the formation of molten material products. U.S. Pat. No. 4,582,116 to Ray et al. discloses a system utilizing a tiltable cooled crucible which contains molten alloy and has a spout for extracting the molten alloy. The alloy is then cast into film products on an advancing chilled surface. The disadvantage of this process is that the axis of rotation of the crucible is along the interface between the crucible and chill block. As the crucible tilts, the gap between it and the moving chill surface varies, depending on the depth of the pouring spout on the crucible. This varying distance between the pour spout and moving chill surface is most undesirable and leads to variations in the thickness of the film deposited on the chill surface.

U.S. Pat. No. 4,612,973 to Whang discloses a cold hearth melt spinning apparatus for continuous casting of refractory and reactive alloys. The apparatus utilizes a cold crucible which has a selectively grooved surface operative to reduce both melt freezing at the melt/crucible interface and input heating power requirements and a replaceable nozzle of a refractory material that is friction fit into an aperture provided therefore in the crucible. The disadvantage of this apparatus is that the reactive liquid must be extruded through a nozzle, thus leading to chemical contamination of the liquid or blocking of the nozzle by freezing of the liquid in the orifice.

U.S. Pat. No. 4,471,831 discloses an apparatus for rapid solidification casting of molten, high-temperature and/or reactive metallic alloys, which has a heat extraction crucible for containing the alloy in liquid form. A nozzle forms an integral part of the crucible and allows for ejection of a stream of molten metal. The heat extracting crucible and nozzle are protected from a molten alloy by a shell of the alloy which has solidified and prevents reaction between the molten metal and the heat extracting crucible. The disadvantage of this apparatus is that the flow through the nozzle cannot be controlled by the apparatus to ensure that the reservoir of liquid is chemically homogeneous before pouring, or that the cooled nozzle will not freeze the liquid and block the flow through the nozzle.

U.S. Pat. No. 4,705,095 describes an improved heat extracting chill block roll and an accompanying method for use in the continuous casting of ribbon-like metal sheet directly from the melt by means of rapid solidification techniques. The resulting product is thicker and more uniform than previously possible utilizing prior art methods and apparatus.

Accordingly, it is an object of the invention to provide an improved apparatus system for forming ribbon, filament, fiber, or film products directly from a molten material that is particularly suitable for positioning and maintaining a constant relationship between the position of the crucible edge over which the molten metal overflows onto a substrate. Without such a system major problems, i.e., material spillage, can arise which result from the small distance separating the receptacle and the chilling substrate.

Other objects and features of the invention are described below and will become apparent from the following detailed description.

BRIEF DESCRIPTION OF INVENTION

The invention relates to an apparatus for producing filament, fiber, ribbon or film for a molten material, and has a crucible that contains a pool of molten material, the free surface of which rises to a desired horizontal level. The crucible has an opening which extends from above the free surface level down to a bottom edge in a crucible wall. The apparatus also has a heat extracting substrate, i.e., a rotating wheel, which is laterally disposed with respect to the crucible and which rotates about an axis of rotation. The rotating substrate is located immediately adjacent the edge of the crucible and its opening, so as to confine the molten material and thus prevent it from overflowing downwardly out of the crucible. The apparatus further has a pair of corresponding arms, each fixed to opposite sides of the crucible and rotate about bearings that are attached to opposite sides of the rotating substrate. These arms tiltably rotate the crucible about an axis of rotation that is coaxial with the axis of rotation of the substrate. Consequently, the crucible edge is maintained at a predetermined, constant distance from the substrate, the particular distance chosen being suitable for depositing the molten material on the substrate. The apparatus also has a pair of drive means or motors, one of which continuously moves the surface of the substrate upwardly past the edge, and past a melt front which forms at the interface of the molten material and the substrate surface, while the other enables the crucible and its arms to tiltably rotate in the manner described.

Figure 1:
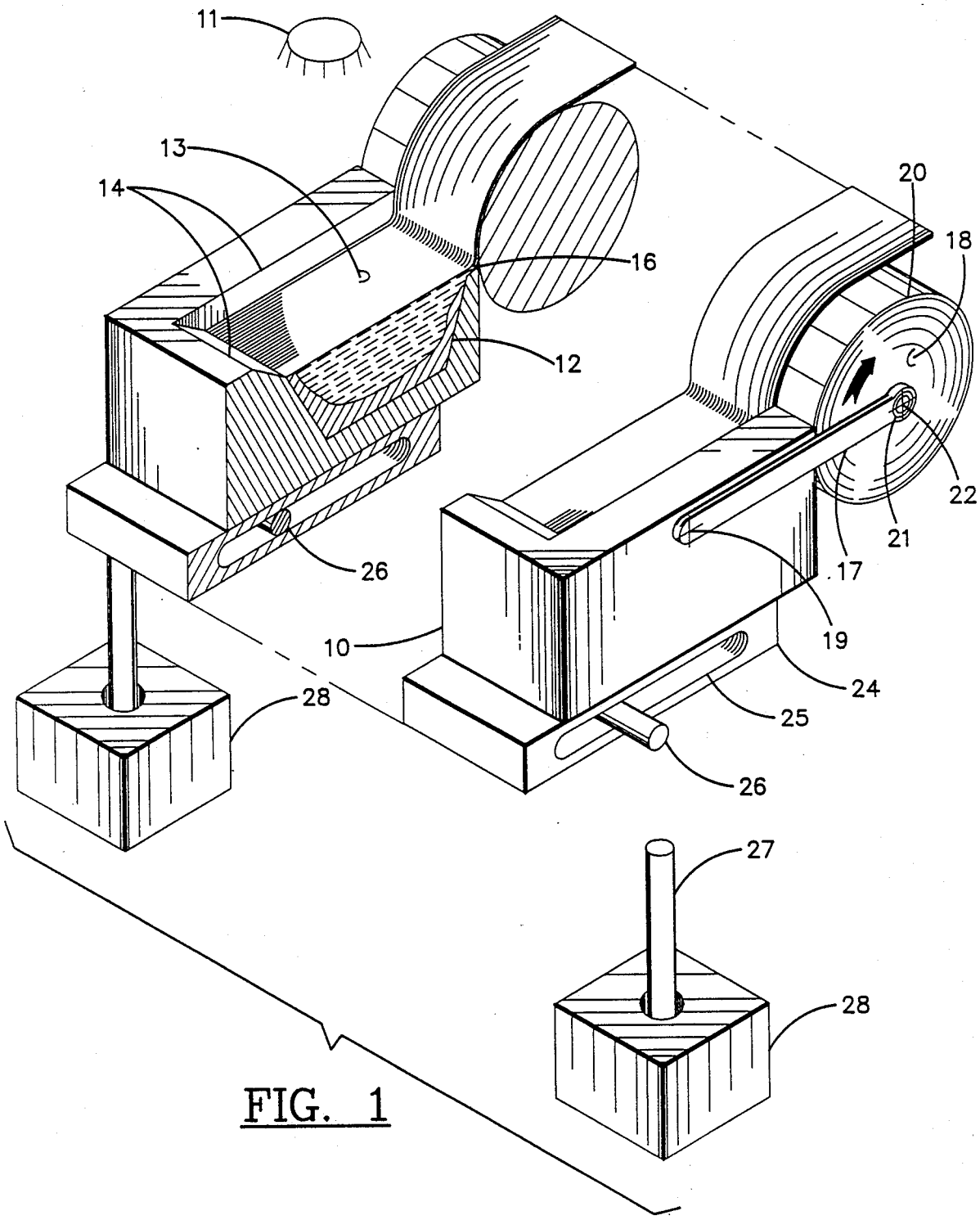
FIG. 1 discloses a simplified illustration of the apparatus setup as applied to a preferred embodiment of the melt overflow system which utilizes the improved rotatable crucible.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

The invention discloses an improved apparatus which is particularly useful in a melt overflow process for producing ribbon, filament, fiber and/or film directly from a molten material, in which the surface of a heat extracting substrate is moved past a region of contact with the molten material to form a layer of material on the substrate, then cooling the material and removing the formed product from the substrate.

In the invention the substrate surface, typically a rotating wheel, which may possess a variety of surface configurations, depending upon the desired product to be made, is moved along a region of contact at an edge of the upper surface of the molten material in the direction generally transverse to the plane of the molten material's surface. Bounding the region of contact is an upper meniscus which is adjacent the upper surface of the molten material. The edge of the preferably heat extracting crucible is sufficiently below the level of the molten material in the crucible such that the molten material solidifies against the edge to protect the crucible from the liquid, but the liquid cannot form and hold a meniscus by surface tension between the solidified layer on the edge and the level of the molten material.

The invention is particularly related to a tiltably rotatable crucible, which is driven by a rotating means that includes a drive means, the crucible containing the molten material. The crucible has attached tilting means on opposite sides, preferably either a pair of longitudinal, arms which are each connected to a separate pivoting means, i.e., a pin, wheel or roller, or, a pair of linear actuator, i.e., motor, driven rods which are vertically positioned beneath the crucible. Each of the rods are driven by a drive means, which exerts a force on the pivoting means which moves within a slot, the resulting movement of which forces the crucible rotatably upward so that the crucible attains a desired edge position with respect to the rotating substrate; more specifically, each embodiment enables the receptacle edge to tiltably rotate about an arc which is located a fixed, desired distance from the axis of rotation of the rotating substrate, e.g., wheel. In such a manner the crucible edge during operation is constantly maintained at a desired distance, e.g., about 1 mm, from the surface of the rotating, heat extracting substrate, thus being in a suitable position for depositing molten material in a desired manner, e.g., by melt overflow techniques, onto the substrate surface. Thus, the crucible of the invention, in contrast to other prior art systems, has its edge rotate about a stationary arc around a desired section of the periphery of the rotating, heat extracting substrate, i.e., the arc also has as its axis of rotation the same axis around which the heat extracting substrate rotates.

The crucible edge is located in a section of the crucible wall which has an opening or lip which is relatively lower than the top of the receptacle. The material is preferably melted by a directed energy source, such as is generated by a plasma, an electron beam, electric arc or laser, in a preferably controlled atmosphere. The liquid material solidifies against the crucible in the preferred embodiment and thus protects it from exposure to, e.g., in the preferred embodiment, a directed energy source, such as those cited above. The crucible tiltably rotates about the rotating substrate during operation and tilts sufficiently to allow the molten material to overflow the edge of the crucible and form a desired film or the like. The movably mounted heat extracting substrate is spaced immediately adjacent from the edge and is contacted by the overflowing molten material substantially at the level of the upper surface of the molten material.

The moving substrate surface thus effectively acts as a replacement for that portion of the container wall which is absent above the edge. The melt overflows against the substrate surface, which may be a cylindrical drum which features a plurality of different patterns, i.e., contours on its surface, and is simultaneously migrated laterally in the direction of movement to produce a desired product, which may be either filament, fiber, ribbon or a film, depending upon a variety of parameters known to one skilled in the art.

Additionally, the invention further includes an additional, i.e., a second drive means for driving the substrate in a known manner so that it will continually move upwardly past the crucible edge that is adapted to receive the melt front which forms at the inner face of the molten material and the substrate surface. It is an element of the invention that when operating in the preferred embodiment, i.e., utilizing a directed energy source, there must be present within the crucible a sufficient depth of molten material so that the bottom surface of the crucible will never be exposed to the outside environment during operation, i.e., it will never be exposed to the energy emitted by the energy source.

FIG. 1 illustrates a preferred mode of operation in which a crucible 10, which is preferably heat extracting, i.e., cooled by water, is heated by a directed energy source 11 such as a plasma, an electric arc, electron beam or a 1 laser, to form a pool of molten material 12. A thin layer 12 of the molten material 13 solidifies on the inner base of the heat extracting crucible 10. However, instead of the walls 14, which surround the pool of molten material being circumferentially continuous, a preferably relatively small section of the container wall is absent in the region above the crucible edge 16, which edge may be either linear or curved in design. The edge 16 is thus at a lower height than the upper surface of the other walls 14 of the crucible 10, so that the molten material level may overflow over the edge 16 when the crucible 10 is tiltably rotated to a predetermined height by movement of a pair of arms 17 (only one shown).

In place of the wall which is missing above the edge 16 there is positioned the peripheral surface 18 of a cylindrical, heat extracting substrate 20, which rotates about its pivot axis 22, and is also the axis of rotation which crucible edge 16 tiltably rotates about. The heat extracting substrate 20 is spaced from the edge 16 and can vertically and horizontally adjust the movements of the crucible edge 16 relative to its surface 18 by the clockwise and counterclockwise rotation of the two pivot arms 17 about bearings 21, which are each positioned on opposite ends of substrate 20. Each arm 17 is thus at one end rigidly secured at 19 to the crucible 10, and at the opposite end pivotably rotates about bearing 21 which is positioned on the drive shaft located at the center of the axis of rotation 22. The movement of crucible 10, to which arm 17 is securely attached at 19, is controlled by the movements of slotted plate or pivot guide 24, which contains a slot or opening 25 that, preferably, extends completely through plate 24 on a substantially horizontal plane. Plate 24 contains a pair of rollers or pins 26, each of which is located on an opposite side of plate 24, and each is connected to the upper end of a rigid arm 27 (only one shown). The pivot arm 27 is driven in a reciprocal manner at a desired rate by drive means 28, such as a motor, crank or cylinder known to those skilled in the art, such that pins 26 each move in a back and forth motion within slot 25, and the resulting movement of the pins controls the precise movements of crucible 10 and pivot arms 17, as described, supra.

Figure 2:
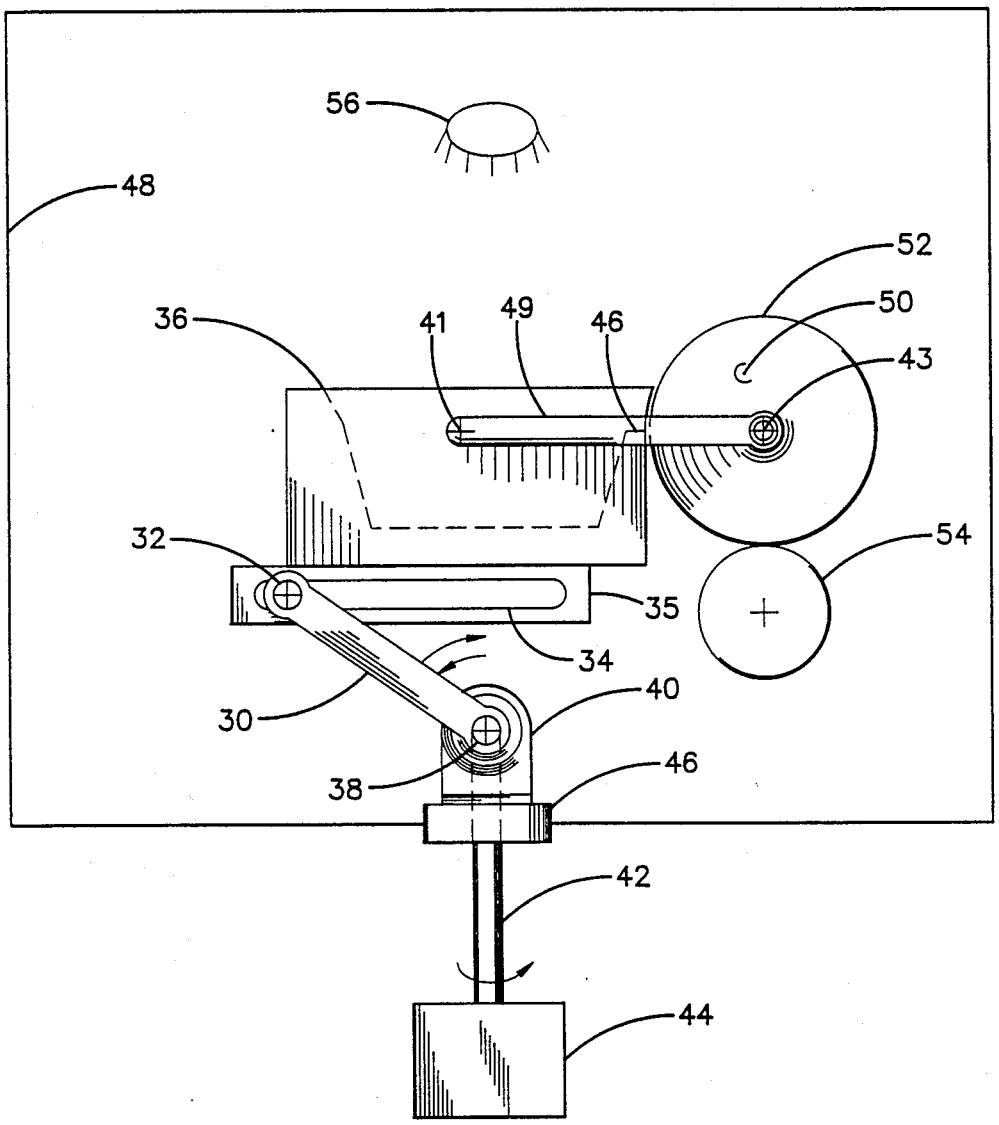
FIG. 2 discloses a side view of a preferred embodiment of the apparatus arrangement, which utilizes a pair of pivot arms as the driving means.

In FIG. 2 there is set forth a side view of one preferred embodiment of the apparatus system. A pivot arm 30 is connected at its upper end to the roller or pin 32, so that as arm 30 pivots in a clockwise or counterclockwise motion, pin 32 moves correspondingly back and forth inside slot 34, which is the opening that extends through slotted plate 35, which also is positioned so as to support crucible 36. Pivot arm 30 is connected at its lower end to, e.g., 45 bevel gears 38, located inside bearing 40. Pivot arm 30 is pivoted by the torque resulting from the rotation of connecting rod 42, or directly to connecting rod 42, and which is connected at its opposite end to a drive mechanism 44 of the type described in FIG. 1. A single rod 42, in a preferred embodiment, passes through rotary vacuum seal 46, which provides a gas tight seal between the rod and chamber 48 during operation. Crucible 36 again moves in a manner governed by the movements of pin 32 in slot 34 as described, supra. Arm 49, which is immovably attached, as previously described in FIG. 1, at 41 to crucible 36, rotates around bearing 43 in the manner previously described with respect to the movement of crucible edge 46. Most preferably, bearing 43 is a graphite sleeve bearing of the type known in the art. The movement of crucible 36 is such that the edge 46 is constantly maintained at a fixed distance, typically about at least 1 mm from the rotating substrate surface 52. Consequently, the edge 46 is constantly positioned along a circumferential arc spaced a fixed, desired distance from wheel 50 for depositing the molten material onto the substrate in a fashion so that the molten material cannot run onto the floor with disastrous results.

Preferably, the overflow edge 46 is linear and the rotating wheel surface 52 is spaced equidistantly from all points along the edge 46. However, the edge may also be contoured and the substrate contoured in a mating form so as to provide a desired shaped product.

The substrate 50 is rotated and cleaned in conjunction with an axial trunion, i.e., a wiper 54 by means of a conventional drive (not shown), such as an electric motor and gear transmission, which drive the wheel surface past the region of its contact with the melt. In most applications it is driven at a substrate surface speed in the range of 150–8000 ft/min. It is to be noted that a variety of other melt overflow embodiments disclosed in Ser. No. 089,544, filed Aug. 26, 1987, can also be used in conjunction with the aforementioned apparatus for rotating the receptacle edge at a fixed distance about a substrate, and the contents of the application referred thereto are hereby Incorporated by Reference. In a preferred embodiment, a directed energy source 56 can be used to melt the material to be processed. As mentioned, supra, the entire system is preferably enclosed in a controlled atmosphere vacuum chamber.

Figure 3:
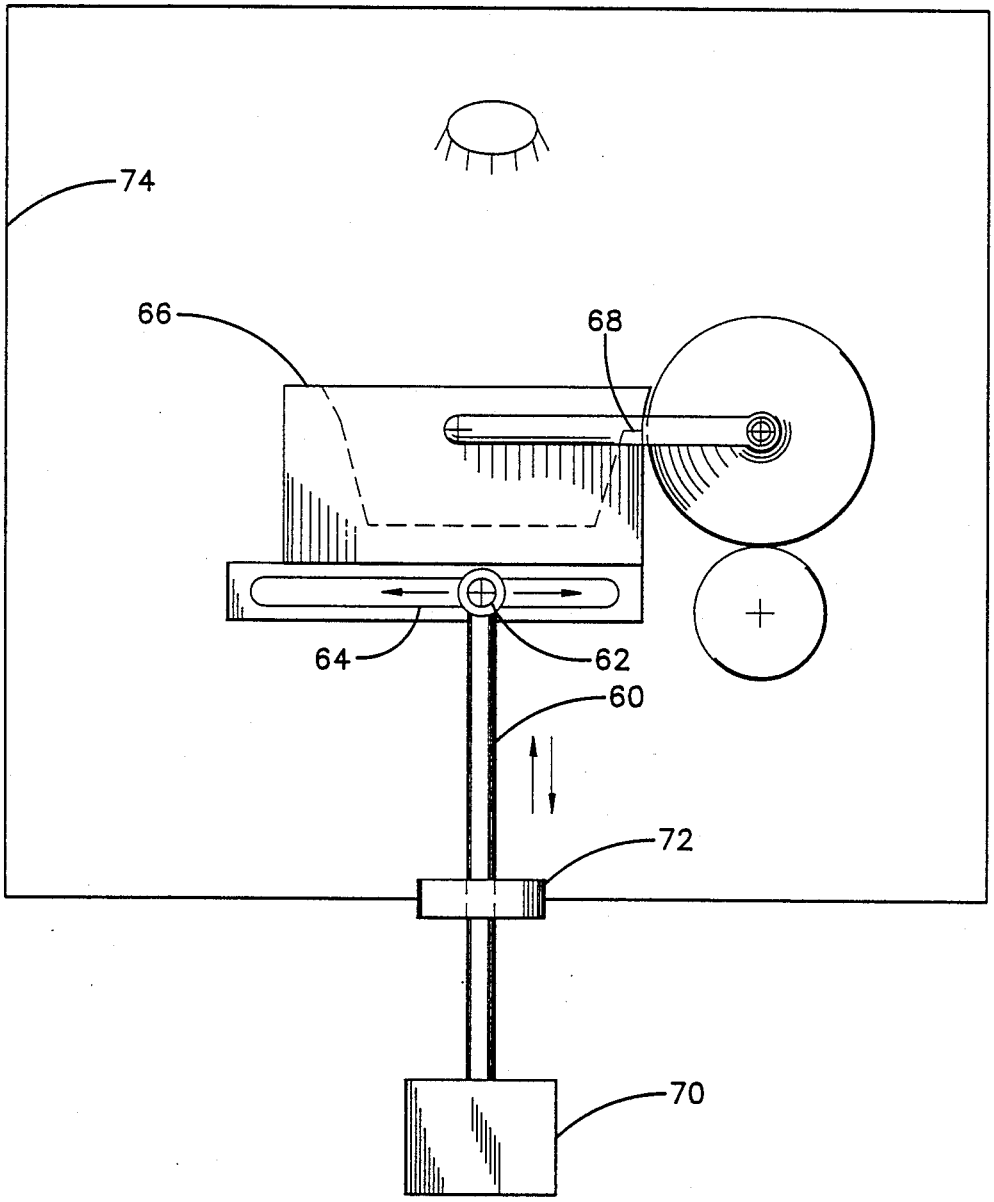
FIG. 3 discloses another side view of a second preferred embodiment which utilizes a pair of linear actuator driven rods as the driving means of the apparatus arrangement.

FIG. 3 discloses another preferred embodiment of an apparatus tilting arrangement of the invention. In the embodiment set forth, the one rod 60 seen in this side view is preferably connected to an apparatus system such as is set forth in FIG. 2, and is attached at an upper end to a pin or wheel 62, such as the pin 32 in the embodiment of FIG. 2, which is positioned to move within a slot 64 which is preferably identical to the slot of the aforementioned embodiment. Rod 60 reciprocates vertically back and forth in a pushing and pulling manner sufficient to impart vertical reciprocating movement to pin 62, which results, as in FIGS. 1 and 2, in the desired movement of crucible 66 and its edge 68, as previously described. Rod 60 is driven by an electric, hydraulic or pneumatic linear actuator or motor 70; however, rod 70 passes through a different seal 72, i.e., a linear, push-/pull seal which is again positioned in the chamber wall to prevent the controlled atmosphere from escaping during the reciprocating pushing and pulling of the rod.

When contacting the molten material with a heat extracting substrate at the edge of the crucible, the substrate is positioned a distance away from the crucible that enables the molten material to be contacted by the heat extracting substrate without the formation of drops which would be subject to detachment. Further, it permits the shear forces induced by the moving surface in the molten material to be upward and opposite from the downward force of gravity.

The area of the melt front which contacts the heat extracting surface is controlled by a horizontal positioning of the receptacle edge 16 and also by a vertical positioning of the rotating substrate, as well as the particular height of the surface of the molten material present in the crucible. The particular height of the melt front is determined by the height of the surface of the molten material above the edge over which the melt overflows.

It is essential that in embodiments which utilize a directed energy source for melting the charge that the crucible, which as mentioned, supra, forms a thin shell upon its base surface during such a "skull melting" process, have a minimum depth of molten material present within. The particular depth required is an amount sufficient such that the bottom of the crucible will never be exposed, i.e., damaged, by the energy emitted by the directed energy source during operation when the crucible is tiltably rotated at angles which can range from about $+30°$, and preferably, about $+15°$ about the horizontal axis of rotation of the substrate.

Figure 4:
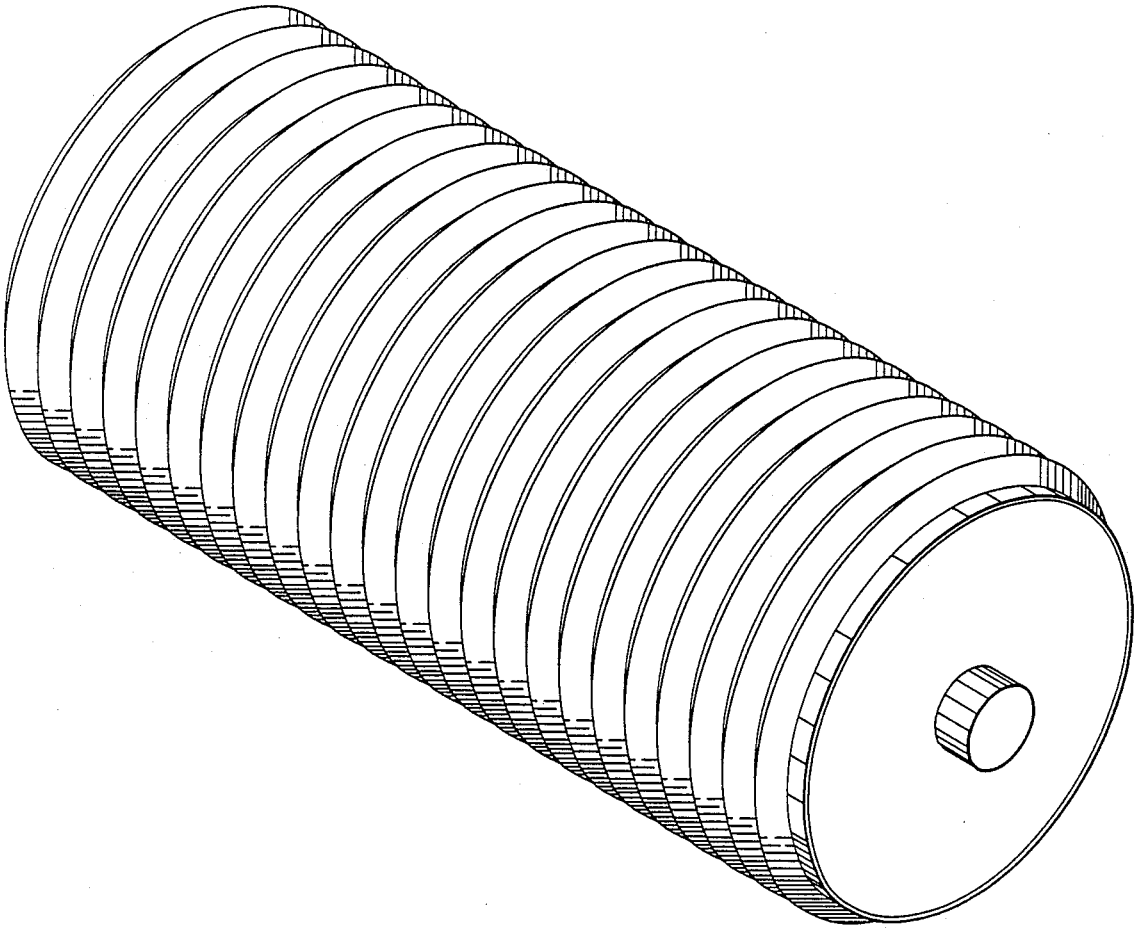
FIG. 4 discloses a side view of a contoured cylindrical substrate suitable for usage in of the present invention.

FIG. 4 illustrates a representative surface having contours which may be formed on a heat extracting substrate and which is suitable for usage with the present invention. The plurality of contours formed on the substrate are simultaneously migrated laterally of the direction of movement during operation. The particular embodiment illustrates contours which are circular, coaxial, laterally spaced and flat-topped helical ridges that are segmented so that short, discreet ribbons of material will be fabricated. However, a variety of other geometric shapes and forms can be utilized to fabricate other desired products, as is well known by one skilled in the art. More particularly, if it is desired to cast ribbon or sheet, the substrate surfaces which are particularly suitable have contours which are knurled or grooved, as well as smooth surfaces. However, if filamentary materials are envisioned, helical grooves are particularly preferred, while for casting fiber, notched grooves are the contoured surface of choice.

The apparatus is substantially intended for usage in a batch type process, particularly a melt overflow process. The apparatus of the invention is preferably utilized in combination with a variety of directed energy melting techniques, such as a plasma, an electric arc, electron beam or laser so as to cast rapidly solidifying reactive metals and alloys. As mentioned, supra, the melt overflow process offer several major advantages over currently available rapid solidification processes. Melt overflow does not extrude the molten metal through an orifice and thus is able to reduce the potential for contamination of reactive metals and alloys from the lining materials in such orifices. Conventional chill block melt spinning and gas atomization processes are limited by melt extrusion and also the entire melt pool's surface is exposed for line of sight access by any directed energy source. Additional advantages are also set forth in previously referred to Ser. No. 089,544. To summarize, the improved apparatus disclosed can be utilized in melt overflow systems to combine the benefits of rapid solidification processing and produce high-quality ribbon, sheet, fiber, and filamentary products from a variety of reactive metals and alloys.

In a preferred embodiment, the heat extracting substrate preferably is made of an alloy which is at least 50% molybdenum, copper, or, if tungsten is being processed, of tungsten. Most preferably, a substantially pure molybdenum substrate is preferred.

The apparatus is particularly useful for processing reactive, refractory or high temperature materials such as titanium, niobium, molybdenum, tungsten and the like.

In a particularly preferred embodiment, it is desirable to evacuate the enclosure to pressures, e.g., below about 5 psi and fill it with a known inert gas, e.g., gases which contain at least 50% argon, helium or nitrogen, as well as mixtures of the above. Preferably the enclosure is filled with the inert gas mixture before melting or casting.

While certain preferred embodiments of the present invention have been disclosed in detail, it is to be understood that various modifications may be adopted without departing from the spirit of the invention or scope of the following claims.

I claim:

1. An apparatus for producing filament, fiber, ribbon or film from a molten material, comprising (a) a crucible for containing a pool of molten material at a selected horizontal level for the free surface of the pool, the crucible having an opening extending from above the free surface level to a bottom edge of the opening;

(b) a heat extracting substrate laterally disposed with respect to the crucible and adaptable for rotating about an axis of rotation; the substrate positioned adjacent the edge and the opening for confining the molten material and preventing it from overflowing downwardly out of the crucible;

(c) rotating means driven by a first drive means and connected to the crucible for tiltably rotating the crucible about an axis of rotation which is coaxial with the axis of rotation of the substrate so the crucible edge is maintained a predetermined constant distance from the substrate, the distance being suitable for depositing molten material on the substrate; and (d) a second drive means drivingly connected to the substrate for continuously moving the surface of the substrate upwardly past the edge and past a melt front formed at the interface of the molten material and the substrate surface.

2. An apparatus in accordance with claim 1 wherein the edge is linear and the substrate is a rotating, generally cylindrical drum.

3. An apparatus in accordance with claim 1 wherein the surface of the substrate consists of an alloy selected from at least 50% of molybdenum, copper or tungsten.

4. An apparatus in accordance with claim 3 wherein the substrate is substantially pure molybdenum.

5. An apparatus in accordance with claim 1 wherein the crucible is a heat extracting crucible.

6. An apparatus in accordance with claim 1 wherein the heat extracting substrate possesses surface contours formed around the axis of rotation on the outer surface of the substrate.

7. An apparatus in accordance with claim 1 wherein the heat extracting crucible edge is maintained at a distance of about 1.0 mm from the substrate.

8. An apparatus in accordance with claim 1 wherein the rotating means for tiltably rotating the crucible is at least one longitudinal pivot arm, the arm being connected at one end to a pivoting means on the crucible and at the opposite end to the drive means.

9. An apparatus in accordance with claim 1 wherein the rotating means for tiltably rotating the crucible comprises at least one rod which is driven by said first drive means, the rod connected at one end to a pivoting means which is vertically positioned beneath the crucible and at the opposite end to the first drive means.

10. An apparatus in accordance with claim wherein a directed energy source suitable for melting material contained in a heat extracting crucible is selected from a plasma, an electric arc, electron beam or a laser.

11. An apparatus in accordance with claim 1 wherein the crucible and heat extracting substrate are contained within an enclosure suitable for evacuating the atmosphere.

12. An apparatus in accordance with claim 1 or 5 wherein the crucible is substantially copper.

* * * * *